US005134660A

United States Patent [19]

Larose

[11] Patent Number: 5,134,660

[45] Date of Patent: Jul. 28, 1992

[54] AUDIO HARNESS FOR VIDEO CAMERA

[76] Inventor: Jean-Paul Larose, R.R. #1, Quyon, Quebec, Canada, J0X 2V0

[21] Appl. No.: 525,029

[22] Filed: May 18, 1990

[51] Int. Cl.[5] ..... H04R 1/02

[52] U.S. Cl. ..... 381/188; 381/26; 381/124; 381/205; 358/229; 358/906; 358/909

[58] Field of Search ..... 381/24, 26, 122, 124, 381/188, 205; 358/209, 229, 906, 909

[56] References Cited

U.S. PATENT DOCUMENTS 3,845,238 10/1974 Schneider et al. ..... 358/209
4,589,134 5/1986 Waldron ..... 381/24
4,764,817 8/1988 Blazek et al. ..... 358/909
4,961,227 10/1990 Le Donne ..... 381/24
4,984,278 1/1991 Frye et al. ..... 381/205

*Primary Examiner*—Walter E. Snow
*Assistant Examiner*—Glenn W. Brown
*Attorney, Agent, or Firm*—David J. French

[57] ABSTRACT

A wiring harness is provided with a miniature speaker and attachment means for connecting the speaker to the microphone on a video camera. The harness is also provided with a plug for coupling the speaker to an audio play-back machine. In this manner a background of music may be laid down on the sound track of home-videos by direct audio input through the microphone pick-up on the video camera.

13 Claims, 4 Drawing Sheets

AUDIO HARNESS FOR VIDEO CAMERA

FIELD OF INVENTION

This invention concerns a wiring harness with audio phones by which sound may be overlaid on the sound track of a video recording.

BACKGROUND TO THE INVENTION

With the advent of the compact video camera, the home recording on video of family scenes has become common. A large part of contemporary video recorders are provided with sound recording systems which lays down a sound track on the video tape itself.

Sound for the sound track is recorded through a microphone, usually mounted on the camera as a built-in feature. This microphone picks up ambient sounds from the scene being video taped.

On many occasions, the sound track may lack interest. It may constitute the shuffling of an audience in a church, waiting for a wedding to commence. Or it may constitute an inarticulate mixture of many persons overtalking each other. In such cases, it would be desirable to provide convenient means to add to the sound-track an overlay of background music.

This invention, therefore, has such an objective, and aspires to meet that objective with an arrangement that is convenient for home video users, and does not entail elaborate post-filming sound transfer activities.

SUMMARY OF THE INVENTION

According to the invention a wiring harness is provided which is adapted to couple the output of a portable audio playback machine to a miniature audio speaker that is provided with attachment means to permit the speaker to be mounted adjacent the microphone pick-up of a video camera with sound-track.

In a more elaborate combination of the invention an off-on switch is associated with such harness and audio playback machine so as to enable a user to turn the audio playback machine "on" or "off" without removing his hands from the camera. This feature may function by operating a remote controlled on-off switch on the playback machine that is already built-in such machine; or the playback machine, if battery powered, may be rendered responsive to a hand-held off-on switch by terminating the connecting wire pair from such switch to the machine to two conductive plates, separated by an insulative plate, to form an assembly that is placed between the battery of the playback machine, and the adjacent battery, or battery-connecting terminal, of that machine.

The audio playback machine may conveniently have a clip that allows it to be hung on a wearer's belt. Typically, a standard audio cassette player may be used. A suitable tape for background music is loaded and set to the beginning of the desired musical passage. The miniature audio speaker is attached to the video-camera microphone, and the user then holds the off-on switch in his hands, simultaneously with holding the video camera. For convenience, the microphone and switch may terminate in a plug into which the balance of the harness may be removably coupled.

The wiring harness may be provided with a splitter that provides a signal to an earphone worn by the operator. This earphone may also be removably coupled to the harness through a plug and jack. However, preferably the operator may connect an earphone to an already-provided output jack on the video camera that allows him to monitor the actual sound being recorded on the video sound track, if such an output is available.

The audio cassette playback sound level is set manually by a test running, with the video camera "off". The cassette is then returned to its starting position.

When the operator desires to commence video recording with sound, he manually triggers both the video camera and the audio player. This can conveniently be done by reason of the feature of the wiring harness which permits the off-on control switch of the invention to be proximate to the video camera. These two devices should preferably be started at the same time. This may particularly be arranged by using as the on-off switch a compression-activated switch that is fastened, as by gluing or by providing the on-off switch with as adhesive pad as an attachment means, on the trigger switch of the video camera.

By selecting appropriate background music, set at a modest level, an entire video scene may be shot with background music immediately in place on the video soundtrack.

Because the miniature audio speaker that provides the background sound is attached directly to the microphone, the level of sound required is low and is relatively unobtrusive. The risk of intrusive noise being generated may be further reduced by placing an insulative sound hood over the miniature speaker.

Because the sound is being provided to the microphone no rewiring of the camera, nor is any interference with its electronic circuits required.

The wiring harness of the invention is inexpensive to produce, and convenient to install. The advantages, in terms of the cost-to-benefit ratio, are substantial.

These, and further features of the invention, will be better understood from the description of the preferred embodiment which now follows.

DESCRIPTION OF THE PREFERRED EMBODIMENT

Figure 1:
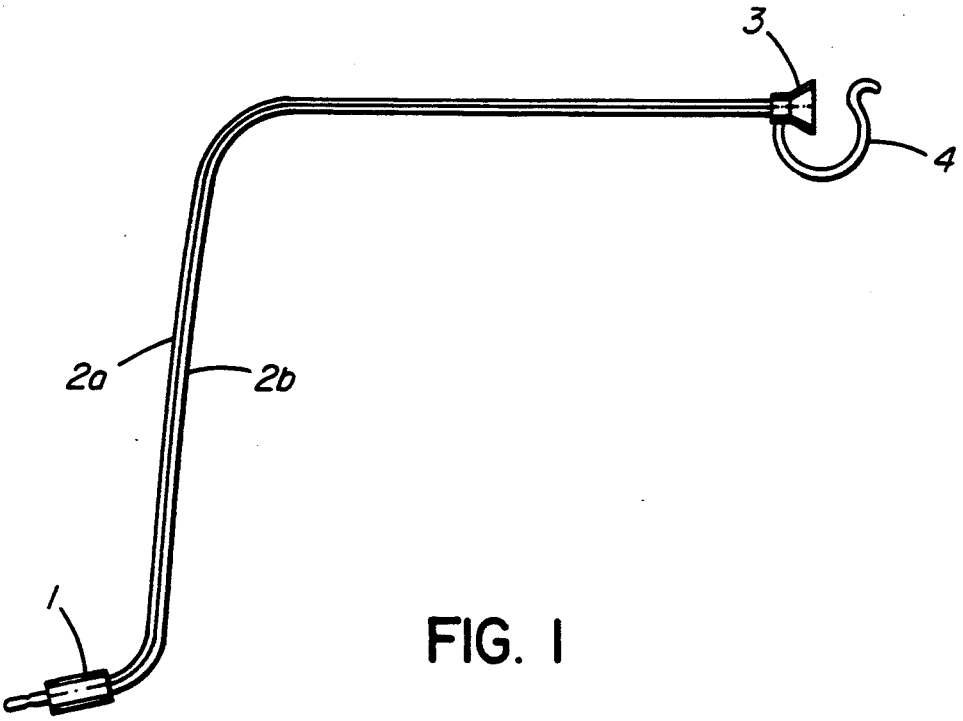
FIG. 1 is a schematic of a wiring harness incorporating the basic feature of the invention.

In FIG. 1 a plug 1 is attached to a pair of wires 2*a*, *b* running to a miniature speaker 3. This speaker 3 may be the earpiece of a conventional miniaturized audio headphone.

Figure 4:
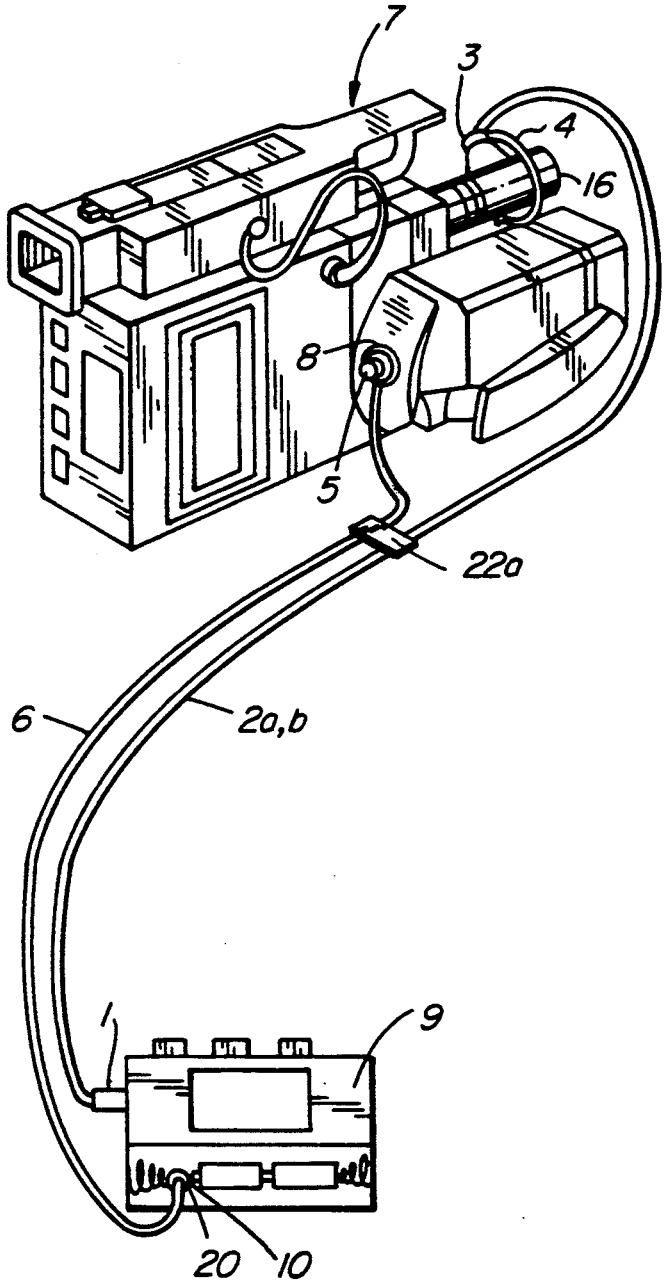
FIG. 4 shows the harness installed between a video camera and an audio player.

The plug 1 is intended for insertion into the audio output jack of an audio playback device 9, as shown in FIG. 4. This plug 1 thereby serves as a coupling means for receiving an audio-equivalent electrical signal from an audio source.

The speaker 3 is attached to a clip 4. This clip 4 is intended to grasp the speaker to the microphone 16 pick-up on a video camera 7, a shown in FIG. 4. With wires 2*a, b* going directly to the speaker 3, these features alone will allow a background sound-track to be laid-down on a video cassette.

Figure 2:
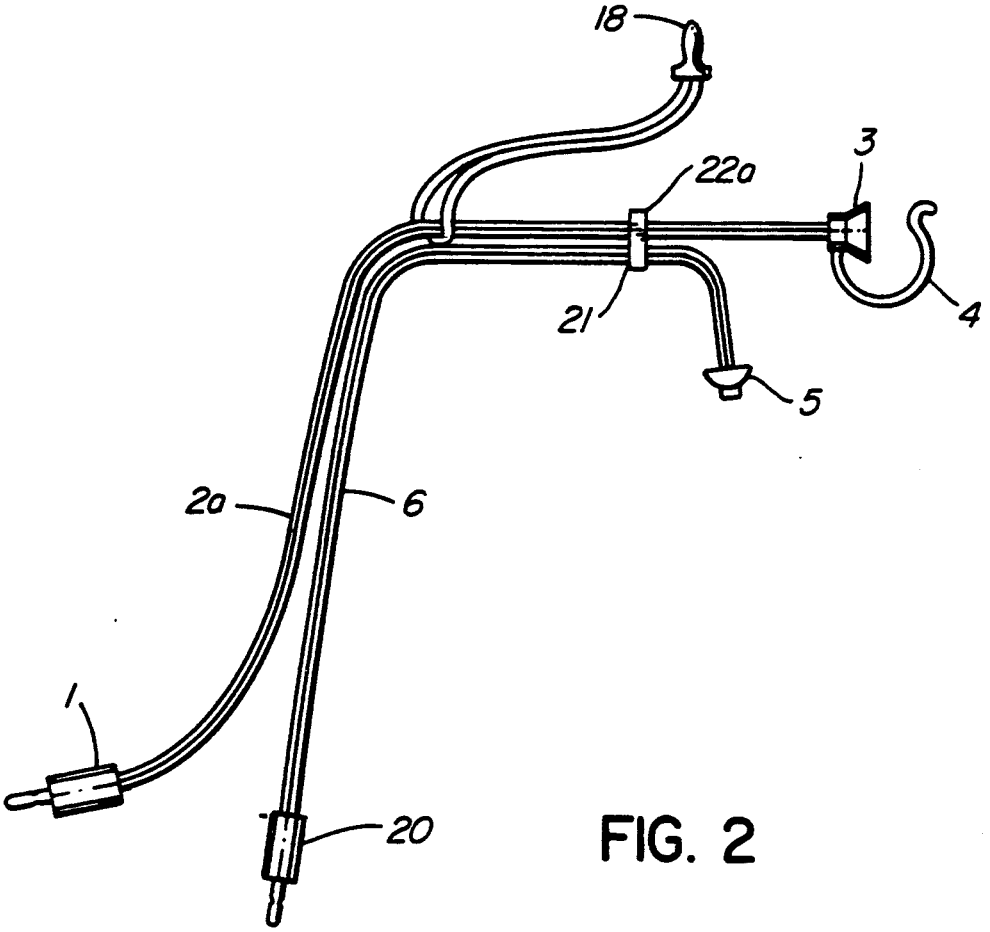
FIG. 2 shows a further alternate wiring harness.

It is convenient to provide an on-off control for the audio player, in conjunction with the wiring harness. This is shown in FIG. 2 wherein conjunction with the wire pair 2*a, b* a second wire pair 6 is run from an on-off control plug 20 to the switches. The on-off control pug 20 is intended for coupling with the remote on-off control port 10 typically found on many audio cassette players (as depicted in FIG. 4). This plug 20 thus constitutes a coupling means for controlling the on-off state of the audio source.

The wire pair 6 is of a length and is attached to the basic wire pair 2*a, b* at a point 21 proximate to the speaker 3 by adhesive tape 22*a*, or other means, so that it may be proximate to the hands of a person holding a video camera 7. This is shown in FIG. 4 where the entire harness is shown extending between the camera and the audio playback device.

The switch 5 should preferably toggle between "on" and "off" positions. It may conveniently be of the compression type and may also be provided with adhesive means 8 for fixing it to the video camera 7. Alternately, the operator may simply hold the switch 5 against the camera 7.

As a further optional arrangement, an earphone 18 may be wired in parallel to the audio feed wires 2*a, b*. This earphone 18 will allow the operator to monitor the sound being introduced into the microphone 16. If the video camera has its own audio jack, the operator may monitor the sound mix as it is being recorded.

Figure 3:
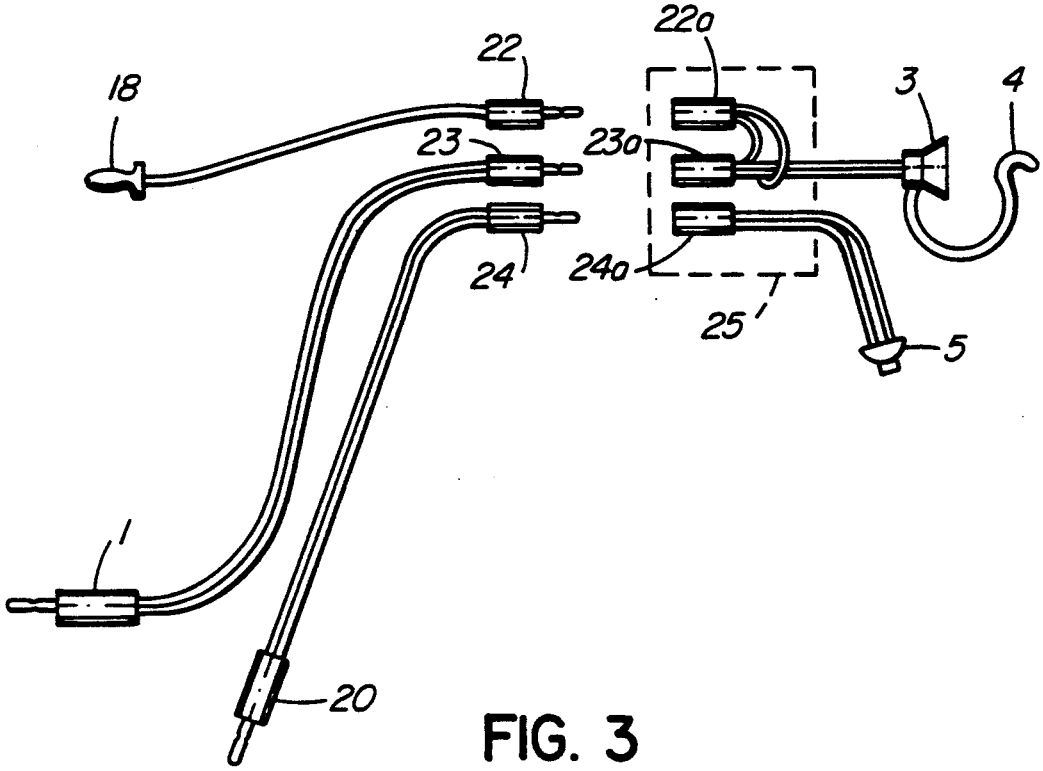
FIG. 3 shows a further alternate wiring harness.

The combined wiring harness may be broken into segments by a series of plugs 22, 23, 24 and jacks 22*a*, 23*a*, 24*a* as shown in FIG. 3. The jacks 22*a*, 23*a*, 24*a*, may optionally be contained in a single box 25, and be mounted on the camera. This allows the camera to be stored without the full wiring harness, while permitting quick attachment at the time of use.

In FIG. 4 an audio playback device 9 is shown which has a pre-built off-on remote control port 10. If this element is not present on the audio player 9, then a simple control system may be based on the features shown in FIG. 4.

Figure 5:
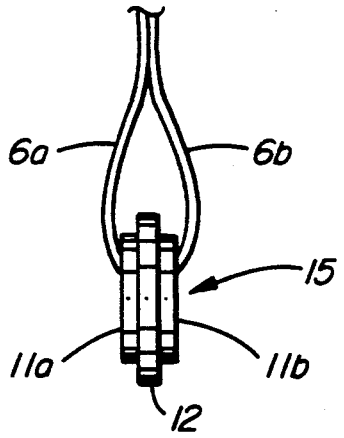
FIG. 5 shows a means of controlling an audio player between "on" and "off" when a remote control port for this function is not provided.
Figure 6:
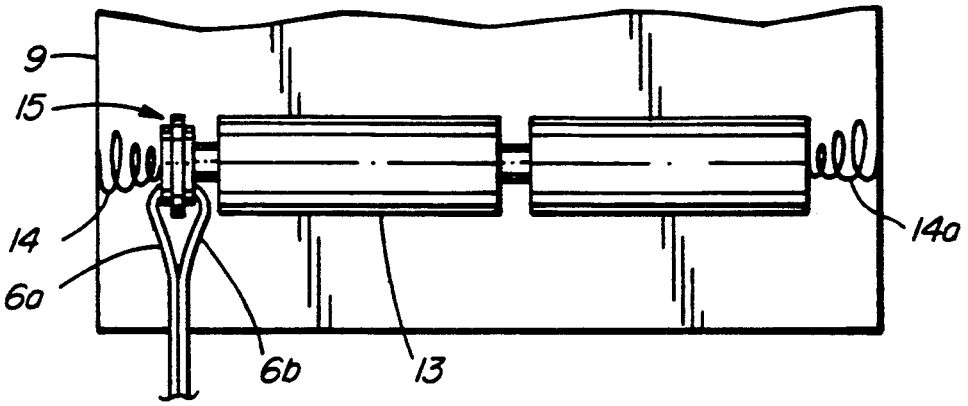
FIG. 6 shows the controlling means of FIG. 4 installed adjacent to a battery.

In FIG. 5 the wires 6*a, b* terminate in small plates 11*a, b*. These may be of brass or another conductive material. The plates 11*a, b*, are separated by an insulative disc 12, to which they are attached on opposite sides. This assembly 15 provides a means of interrupting current flow from a battery 13, into a battery terminal 14 on the player 9. To effect such an interruption, the assembly 15 is slid between the battery 13 and one of its terminals 14,14*a* or between two batteries that are in series. Once this is done the player 9 will turn off and on in accordance with the switch 5 by reason of the interruption to the battery circuit made possible by the insertion of the assembly 15 in series with the battery circuit.

Figure 8:
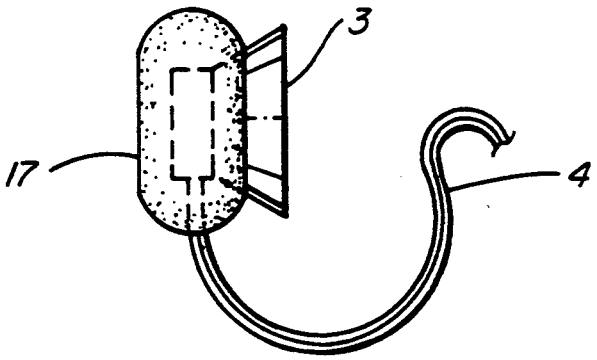
FIG. 8 shows a single speaker arrangement.

The speaker 3 is provided with an attachment means 4 to hold it against the video camera microphone 16. It may also be provided with a supplementary sound cover 17 of sponge or the like to reduce the level of sound being projected outwardly. This is shown in FIG. 8.

Figure 7:
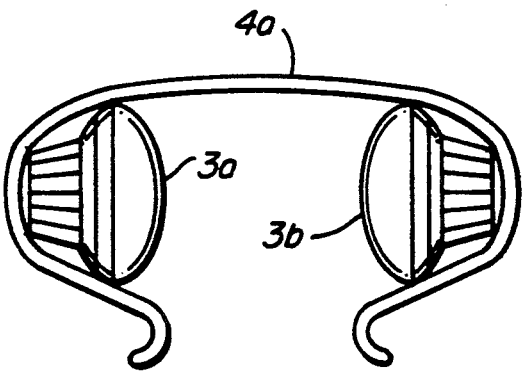
FIG. 7 shows a double speaker arrangement.

While a single speaker 3 has been shown, it is permissible to substitute a speaker pair, such as shown in FIG. 7. In this case the clip 4*a* embraces both speakers 3*a*, 3*b*, and permits them to be held symmetrically to the microphone. Such an arrangement is suitable when a stereo audio player is used.

On the basis of the foregoing it will be seen that a simple and convenient arrangement may be provided for adding background music to the sound-track of a video recording.

The foregoing has been a description of several preferred, exemplary embodiments of the invention. The invention in its broadest and more particular aspects is further described and defined in the claims which now follow.

I claim:

1. A wiring harness for connecting an audio source to a microphone on a video camera, the microphone having an exposed exterior surface, said harness comprising a first wire pair terminating at one end in a first coupling means adapted to receive an audio-equivalent electrical signal from said audio source, and terminating at its other end in a speaker, wherein said speaker is provided with attachment means for locating said speaker in direct contact with the exterior surface of the microphone of said video camera so as to direct sound preferentially into said microphone.

2. A wiring harness as in claim 1 further comprising a second wire pair terminated at one end by an on-off switch and at the other end by a second coupling means for engaging with and controlling the on-off state of said audio source.

3. A wiring harness as in claim 2 wherein said on-off switch is proximate to said speaker.

4. A wiring harness as in claim 2 wherein said on-off switch is provided with switch attachment means for attaching said switch to a trigger which also operates said camera.

5. A wiring harness for connecting an audio source located at a position removed from the location of a video camera to a microphone of said video camera for recording a scene, said microphone having an exposed exterior surface, comprising a first wire pair terminating at one end in a first coupling means adapted to receive an audio-equivalent electrical signal from the audio source, and terminating at its other end in a speaker, the speaker being provided with attachment means for locating the speaker in direct contact with the exterior surface of the microphone to thereby direct sound input preferentially into the microphone without projecting a substantial amount of sound outwardly into the scene being recorded.

6. A wiring harness as in claim 5 wherein the speaker is provided with a sound cover for reducing the level of sound projected outwardly from the rear of the speaker into the scene being recorded.

7. A wiring harness as in claim 5 comprising a second wire pair terminated at one end of an on-off switch and at the other end by a second coupling means for engaging with and controlling the on-off state of said audio source, said second wire pair being of a length to permit such on-off switch to be positioned proximate to said speaker and video camera.

8. A wiring harness as in claim 7 wherein said video camera is provided with a trigger switch which operates the camera, and said on-off switch is a compression-type activated switch mounted on the camera trigger by switch attachment means so that the manual application of pressure to the on-off switch activates the camera trigger.

9. A wiring harness as in claim 7 wherein said audio source is powered by a battery mounted between battery terminals, and said second coupling means is electrically connected to two conductive plates sandwiching opposed sides of an insulative disc to form an assembly, said assembly being of dimensions suitable to permit it to be placed between two batteries or between a battery and a battery terminal within said audio source.

10. A wiring harness as in claim 7 comprising an earphone with leads connected in parallel with said first wire pair.

11. A wiring harness as in claim 6 comprising an earphone with leads connected in parallel with said first wire pair.

12. A wiring harness as in claim 5 comprising an earphone with leads connected in parallel with said first wire pair.

13. In combination with an audio source and a video camera having a microphone with an exposed exterior surface mounted thereon, a wiring harness comprising a first wire pair terminating at one end in a first coupling means adapted to receive an audio-equivalent electrical signal from said audio source, and terminating at the other end of the first wire pair in a speaker, wherein said speaker is provided with attachment means for locating said speaker in direct contact with the exterior surface of the microphone of said video camera to thereby direct sound input preferentially into the microphone without projecting a substantial amount of sound outwardly into the scene being recorded.

* * * * *